US009125510B2

(12) United States Patent
Fulton et al.

(10) Patent No.: US 9,125,510 B2
(45) **Date of Patent: *Sep. 8, 2015**

(54) TRACK FOR AN ADJUSTABLE BLIND ASSEMBLY

(71) Applicant: Masonite Corporation, Tampa, FL (US)

(72) Inventors: Daniel Fulton, Charlotte, NC (US); Matthew White, Charlotte, NC (US)

(73) Assignee: Masonite Corporation, Tampa, FL (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/469,237

(22) Filed: Aug. 26, 2014

(65) Prior Publication Data

US 2014/0359971 A1 Dec. 11, 2014

Related U.S. Application Data

(60) Continuation of application No. 13/829,101, filed on Mar. 14, 2013, now Pat. No. 8,813,808, which is a division of application No. 12/796,697, filed on Jun. 9, 2010, now Pat. No. 8,807,191.

(60) Provisional application No. 61/185,224, filed on Jun. 9, 2009.

(51) Int. Cl.

| | |
|---|---|
| ***E06B 3/32*** | (2006.01) |
| ***A47H 1/18*** | (2006.01) |
| ***E06B 7/30*** | (2006.01) |
| ***E06B 9/264*** | (2006.01) |
| ***E06B 9/327*** | (2006.01) |

(52) U.S. Cl.

CPC .. *A47H 1/18* (2013.01); *E06B 7/30* (2013.01); *E06B 9/264* (2013.01); *E06B 9/327* (2013.01); *Y10T 16/354* (2015.01)

(58) Field of Classification Search

CPC ..... E06B 9/327; E06B 9/264; E06B 7/30; A47H 1/18; Y10T 16/354

USPC .... 160/107, 168.1 R, 177 R, 176.1 R, 172 R; 52/105

See application file for complete search history.

(56) References Cited

U.S. PATENT DOCUMENTS

| | | | |
|---|---|---|---|
| 2,379,747 | A | 7/1945 | Richards |
| 3,070,856 | A | 1/1963 | Minick |
| 3,708,927 | A | 1/1973 | Cohen |
| 4,836,494 | A | 6/1989 | Johnsen |
| 4,987,943 | A | 1/1991 | Charest |
| 5,303,895 | A | 4/1994 | Hart |
| 5,409,191 | A | 4/1995 | Wenmaekers |
| 5,779,384 | A | 7/1998 | Olsen |
| 5,826,638 | A | 10/1998 | Jelic |
| 5,996,668 | A | 12/1999 | DeBlock et al. |
| 6,035,920 | A | 3/2000 | Lassen et al. |
| 6,141,874 | A | 11/2000 | Olsen |
| 6,328,090 | B1 | 12/2001 | Anderson et al. |
| 6,561,841 | B2 | 5/2003 | Norwood |
| 6,601,633 | B2 | 8/2003 | Sun et al. |

(Continued)

*Primary Examiner* — Katherine Mitchell
*Assistant Examiner* — Johnnie A Shablack
(74) *Attorney, Agent, or Firm* — Berenato & White, LLC

(57) ABSTRACT

A track for an adjustable blind assembly is disclosed. One described track for an adjustable blind assembly comprises a track comprising a base and a slot, the base comprising a flange portion and a brace portion, the flange portion extending from the base and securable to a spaced window pane by a window frame, and the slot extending from the base and comprising a channel for a sliding adjuster.

20 Claims, 5 Drawing Sheets

(56) References Cited

U.S. PATENT DOCUMENTS

| | | | |
|---|---|---|---|
| 6,736,185 | B2 | 5/2004 | Smith et al. |
| 6,758,016 | B2 | 7/2004 | Gobeil |
| 6,817,401 | B2 | 11/2004 | Sun et al. |
| 6,932,139 | B2 | 8/2005 | Early et al. |
| 7,000,670 | B2 | 2/2006 | Kwon et al. |
| 7,082,982 | B2 | 8/2006 | Eveland et al. |
| 7,155,863 | B2 | 1/2007 | Daniel et al. |
| 7,191,817 | B2 | 3/2007 | Nicolosi |
| 7,201,205 | B2 | 4/2007 | Lyness et al. |
| 7,263,808 | B2 | 9/2007 | Massey et al. |
| 7,475,715 | B2 | 1/2009 | Gardner et al. |
| 7,543,623 | B2 | 6/2009 | Allardyce et al. |
| 7,669,633 | B2 | 3/2010 | Berger |
| 7,748,175 | B2 | 7/2010 | Liebendorfer |
| 7,804,032 | B2 | 9/2010 | Wilker et al. |
| 7,896,056 | B2 | 3/2011 | Ben-David |
| 7,926,213 | B1 | 4/2011 | Kludt et al. |
| 7,942,184 | B2 | 5/2011 | Cech et al. |
| 8,074,698 | B2 | 12/2011 | Allsopp |
| 8,082,969 | B2 | 12/2011 | Okachi |
| 8,176,961 | B2 | 5/2012 | Pelekanos |
| 8,297,334 | B2 | 10/2012 | Chu |
| 8,407,947 | B2 | 4/2013 | Yaggi, Jr. et al. |
| 8,807,191 | B2 | 8/2014 | Fulton et al. |
| 8,813,808 | B2 | 8/2014 | Fulton et al. |
| 2005/0000165 | A1 | 1/2005 | Dischinat et al. |
| 2006/0118250 | A1 | 6/2006 | Jin et al. |
| 2008/0029226 | A1 | 2/2008 | Huang |
| 2008/0169070 | A1 | 7/2008 | Mullet et al. |
| 2009/0038764 | A1 | 2/2009 | Pilz |
| 2009/0049765 | A1 | 2/2009 | Grant |
| 2009/0165405 | A1 | 7/2009 | Fagan et al. |
| 2009/0236485 | A1 | 9/2009 | Goepfert et al. |
| 2010/0071857 | A1 | 3/2010 | Hung |
| 2010/0095607 | A1 | 4/2010 | Bennett et al. |
| 2011/0019348 | A1 | 1/2011 | Kludt et al. |
| 2011/0100570 | A1 | 5/2011 | DiStefano |

TRACK FOR AN ADJUSTABLE BLIND ASSEMBLY

CROSS-REFERENCE TO RELATED APPLICATIONS AND CLAIM TO PRIORITY

This patent application is a continuation of Ser. No. 13/829,101, filed Mar. 14, 2013, now U.S. Pat. No. 8,813,808 which is a divisional of application Ser. No. 12/796,697, filed Jun. 9, 2010, now U.S. Pat. No. 8,807,191 which claims the benefit of U.S. Provisional Application No. 61/185,224, entitled "Track for an Adjustable Blind Assembly," and filed Jun. 9, 2009, the entirety of which is incorporated herein by reference and to which priority is claimed.

FIELD OF THE INVENTION

The present disclosure relates generally to a track for an adjustable blind assembly within a multiple-pane window and a method for making a window assembly.

BACKGROUND OF THE INVENTION

Various designs for multiple-pane window blinds have been developed. In such assemblies, window blinds are placed between two panes of glass and surrounded by a frame. Between the panes of glass there may be a mechanism for tilting the blinds, as well as a mechanism for raising and lowering the blinds. These mechanisms are well known in the art and may include cords, pulleys, or rotating bars.

For instance, a cord may be attached to an operator at one end and attached at the other end to a set of blinds through a series of pulleys. The operator may be moved up and down by an adjuster located on the exterior of the glass. The adjuster and the operator may be magnetically coupled to each other so that movement in one leads to movement in other. As the operator is moved up and down, the cord will move in response, raising or lowering the blinds. In addition, an operator may be attached to a mechanism, such as a rotating bar, to tilt the blinds between an open to a closed position. These operators can be separate, or a single operator and adjuster combination may perform both functions.

In such blind assemblies, the adjuster may be attached a number of different ways: it may ride along the exterior of a pane of glass, being held in place through only its magnetic attraction to the operator; it may attach to a track formed integrally with the frame; and it may attach to a track which is then secured directly to the exterior of a pane of glass. Each of these methods, however, has drawbacks.

When attached to the operator via the magnetic attraction only, the adjuster will move along the surface of the glass, which may lead to scratching and marking. Also, the force exerted by a user may overcome the magnetic force between the adjuster and the operator, causing them to dislodge.

When the track is integrally formed with the frame, a flexibility problem may arise. Depending on the size of the window and the specific blind adjustment mechanisms, the location of the operator with respect to the edge of the frame may vary. To accommodate for these differences a new frame must be designed and made for each application. Where a track is attached directly to a pane of glass, repeated use may weaken the bond between the two. This may eventually cause the track to fall off and the adjuster to dislodge from the operator. Thus a need exists for an improved track for an adjustable blind assembly.

BRIEF SUMMARY OF THE INVENTION

The present invention is directed to a track that may be used for an adjustable window assembly in a multiple-pane window which overcomes the disadvantages of the prior art. In accordance with one embodiment, a track for an adjustable blind assembly comprises a track comprising a base and a slot, the base comprising a flange portion and a brace portion, the flange portion extending from the base and securable to a spaced window pane by a window frame, and the slot extending from the base and providing a channel for a sliding adjuster.

In addition, the present invention is directed to a window assembly. A window is provided comprising a frame, first and second spaced panes, and a window covering assembly located between the panes. The window assembly also comprises a track comprising a base and a slot, the base comprising a flange portion and a brace portion, wherein at least a portion of the flange portion extends into the frame, the slot extending from the base and providing a linear channel for a sliding adjuster. The window assembly also comprises a sliding adjuster engaging the slot and operably associated with the window covering assembly.

The present invention is also directed to a method for making a window assembly. The method comprises the steps of providing a window comprising a frame, a first spaced pane, and a second spaced pane within the frame; providing a window covering assembly located between the spaced panes; providing a track with a base and a slot, the base comprising a flange portion and a brace portion; and positioning at least a portion of the flange portion of the track within the frame.

Other aspects of the invention, including apparatus, systems, methods, and the like which constitute part of the invention, will become more apparent upon reading the following detailed description of the exemplary embodiments and viewing the drawings.

BRIEF DESCRIPTION OF THE DRAWINGS

The accompanying drawings are incorporated in and constitute part of the specification. The drawings, together with the general description given above and the detailed description of the exemplary embodiments and methods given below, serve to explain the principles of the invention. In such drawings.

DETAILED DESCRIPTION OF THE PREFERRED EMBODIMENTS

Figure 1:
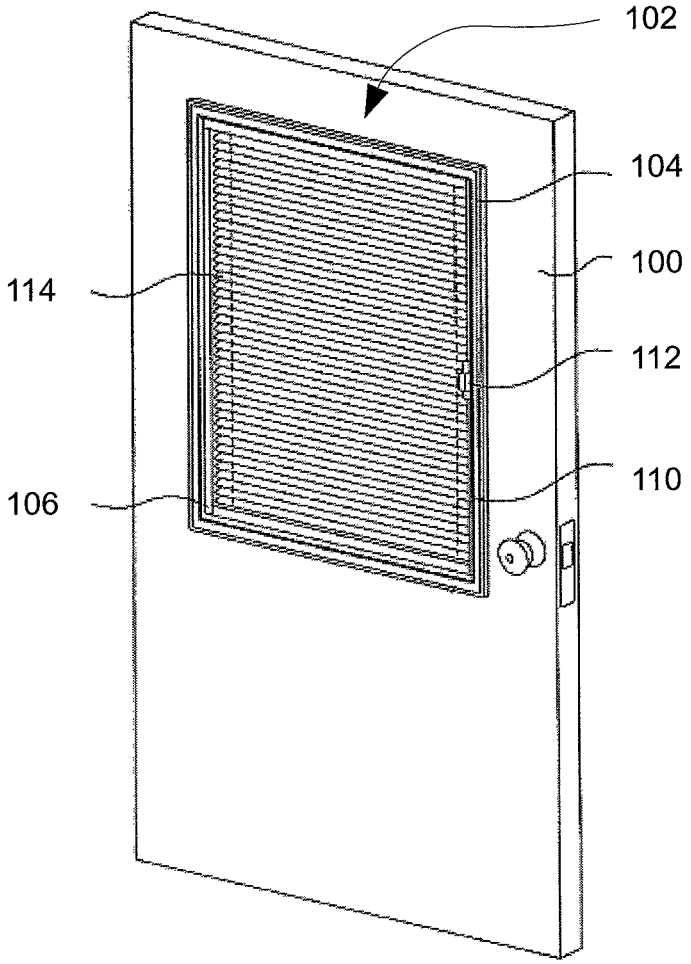
FIG. 1 is a perspective view of an adjustable blind assembly in combination with a door according to an embodiment of the invention.

Reference will now be made in detail to exemplary embodiments and methods of the invention as illustrated in the accompanying drawings, in which like reference characters designate like or corresponding parts throughout the drawings. It should be noted, however, that the invention in its broader aspects is not limited to the specific details, representative devices and methods, and illustrative examples shown and described in this section in connection with the exemplary embodiments and methods. The invention according to its various aspects is particularly pointed out and distinctly claimed in the attached claims read in view of this specification, and appropriate equivalents.

FIG. 1 is a perspective view of an adjustable blind assembly in combination with a door according to an embodiment of the invention. The device shown in FIG. 1 comprises a door 100 with a window 102. The window 102 comprises a frame 104 which holds a first spaced pane 106 and a second spaced pane (not shown in FIG. 1). The frame 104 surrounds the window assembly and acts to hold it in place. The frame 104 may be a single unitary piece, or it may be comprised of multiple pieces that connect together.

An adjustable window covering, such as an adjustable blind assembly 114, is located in the space between the first spaced pane 106 and the second spaced pane. The adjustable window covering may comprise other types of windows coverings, such as curtains, shades, shutters, etc. The adjustable blind assembly (i.e. blinds) 114 may be pulled up or down, and/or tilted for varying degrees of transparency or opaqueness.

As shown in FIG. 1, the first spaced pane 106 is located on the interior side of the door 100, while the second pane is located on the exterior side of the door 100. In other configurations, the first spaced pane 106 is located on the exterior side of the door 100. Though panes of glass are contemplated for certain embodiments, other materials may be used such as a transparent or translucent plastic.

The door 100 also comprises a track 110 and a sliding adjuster 112. The track 110 comprises a base and a slot, described in detail below. The base of the track 110 comprises a flange portion that extends from the base of the track 110 and into the window frame 104, and is thereby held or secured to the first spaced pane 106. The base of the track 110 also comprises a slot extending from the base and providing a channel for the sliding adjuster 112. The slot may comprise a channel, such as a narrow space for receiving the sliding adjuster 112. As one example, the slot comprises a hook that defines a groove in the track for the sliding adjuster 112 to move along.

The sliding adjuster 112 is connected to the track 110. The track 110 may be disposed partially or completely on the surface of the first window pane 106. A portion of the track 110, i.e. the flange portion extends into the frame 104.

The sliding adjuster 112 causes the adjustable window covering 114 to move between the first and second spaced panes. The sliding adjuster 112 may adjust the adjustable window covering 114, for example, by pulling up blinds or curtains. For example, as the sliding adjuster 112 is moved up and down the track 110, the adjustable window covering 114 is raised or lowered accordingly. Or, the sliding adjuster 112 may adjust the angle of tilt, or rotation, of an adjustable window covering 114. Additionally, a separate operator, track and adjuster (not shown in FIG. 1) may be provided in the assembly for tilting the blinds between an open position to a closed position, though a single adjuster may perform both functions.

The operation of adjustable blinds is well known in the art and will not be discussed in detail. Numerous devices and methods can be used to raise and lower the blinds, as well as tilt the blinds from an open to a closed position. An example of such a system is described in commonly owned U.S. Published Patent Application 2007/0017644, the disclosure of which is incorporated herein by reference.

Figure 2:
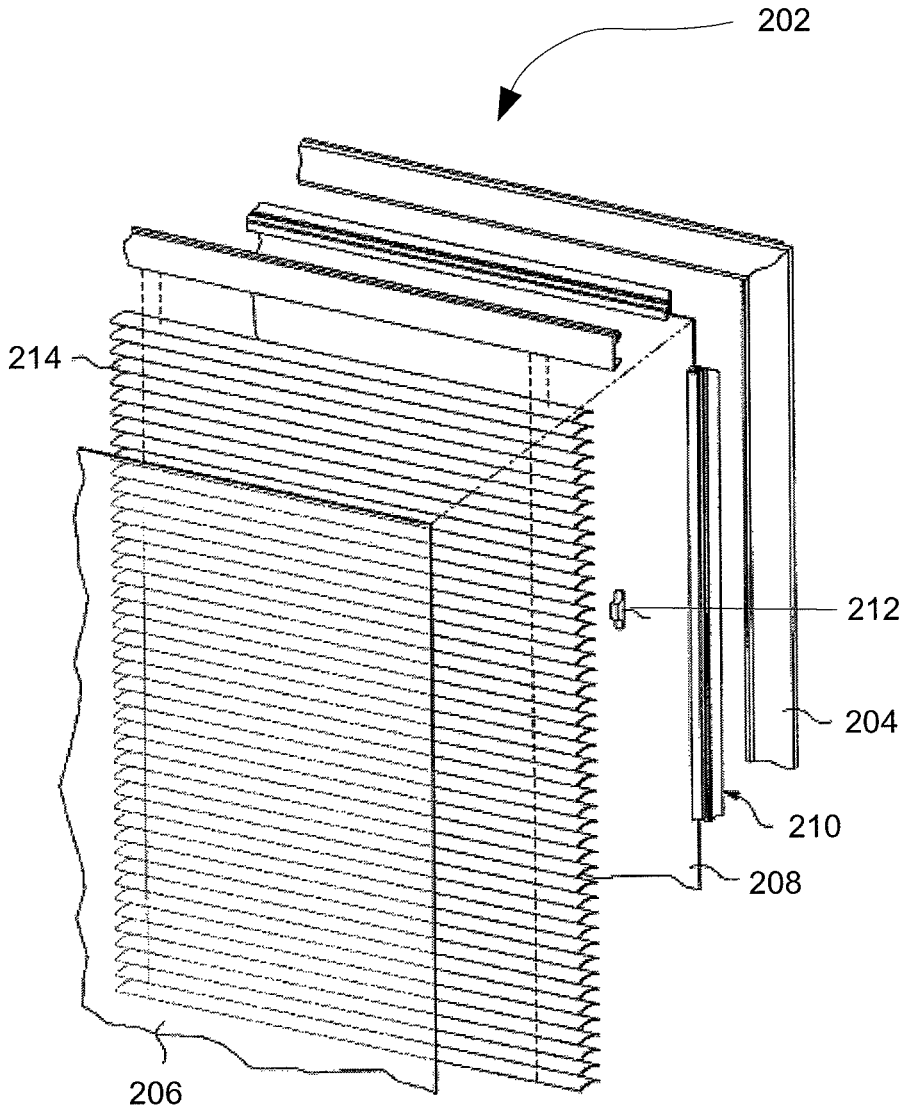
FIG. 2 is a fragmentary exploded assembly view of an adjustable blind assembly according to the invention.

FIG. 2 is a fragmented exploded assembly view of an adjustable blind assembly according to another embodiment of the invention. A window 202 is illustrated in FIG. 2. The window 202 comprises a window frame 204 which holds a first spaced pane 206 and a second spaced pane 208 in place. An adjustable window covering, such as adjustable window blinds 214, lies between the first pane 206 and the second pane 208.

The window 202 also comprises a track 210 and a sliding adjuster 212. The sliding adjuster 212 adjusts the positioning of the blinds 214, for example, by extending the blinds 214 downward, retracting the blinds 214 upward, and/or by tilting the blinds 214. Thus the sliding adjuster 212 adjusts the light visible through the window 202.

Figure 3A:
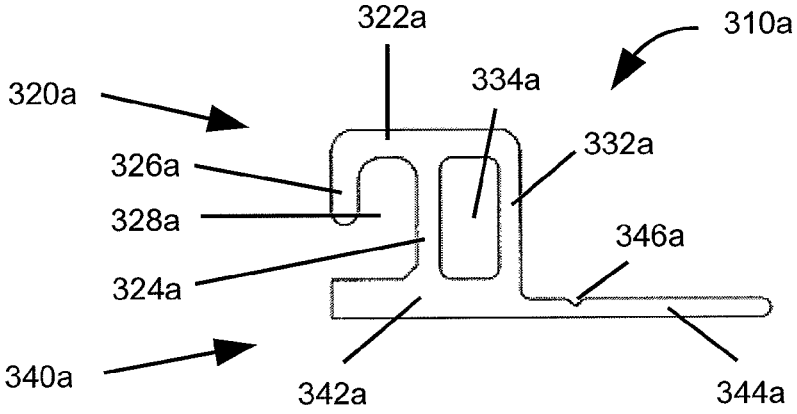
FIG. 3*a* is a side elevational view of a track according to the invention.

FIG. 3*a* is a side elevational view of a track according to another embodiment of the invention. FIG. 3*a* illustrates track 310*a* comprising a base 340*a* and a slot 320*a*. The slot 320*a* comprises a channel 328*a*, such as a hook defining a groove. As shown in FIG. 3*a*, the channel 328*a* is formed by the top wall 322*a*, side wall 324*a*, and protrusion 326*a*. In some embodiments, the walls 322*a*, 324*a* and/or protrusion 326*a* may be rounded, thus forming a rounded channel 328*a*. In other embodiments, the walls 322*a*, 324*a* and/or protrusion 326*a* are more rectangular and less rounded.

A sliding adjuster (not shown in FIG. 3*a*) engages the slot 320*a*, for example, by fitting around the projection 326*a* into the channel 328*a*. The sliding adjuster can form a slidable connection with the channel 328*a*, so that the sliding adjuster may move up and down the track 310*a*.

The track 310*a* may further comprise additional structural members for additional strength and stability. As shown in FIG. 3*a*, the track 310*a* further comprises a back wall 332*a*, which connects with the top wall 322*a* to form a hollow tubular section 334*a*. The hollow tubular section 334*a* may resist bending of the track while the sliding adjuster slides up and down the channel 328*a*. Other embodiments of the invention may comprise other structures for additional strength and support.

The base 340*a* comprises a brace portion 342*a* and a flange portion 344*a*. The flange portion 344*a* extends away from the slot 320*a* and is designed to be positioned at least partially inside a window frame. By fitting the flange portion 344*a* into the window frame, the window frame can hold the flange portion 344*a*, against a window pane. Thus the flange portion 344*a* engages the window frame, and secures the track against the window pane.

The base 340*a* also comprises a notch 346*a*. As shown in FIG. 3*a*, the notch 346*a* is located on a top side of the base 340*a*. The notch 346*a* may be used to align the track 310*a* with an adjustable window assembly. For example, the flange portion 344*a* may be positioned inside a window frame up to the notch 346*a*. In some embodiments, the base 340*a* includes multiple notches 346*a*.

Figure 3B:
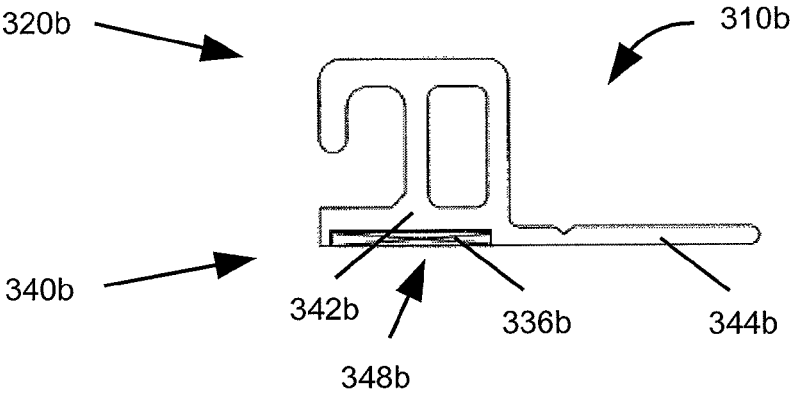
FIG. 3*b* is a side elevational view of a track according to another embodiment of the invention.

In some embodiments, it may be desired to provide additional securing force to the track, apart from the force applied by the frame on the flange portion 344*a* against the window pane. FIG. 3*b* is a side elevational view of a track according to another embodiment of the invention. FIG. 3*b* illustrates a track 310*b* comprising a slot 320*b* and a base 340*b*. The base 340*b* comprises a brace portion 342*b* and a flange portion 344*b*. As shown in FIG. 3*b*, the brace portion 342*b* comprises an adhesive slot, or opening 348*b*. The opening 348*b* may be defined as a space between a window pane and a section of the base 340*b*. An adhesive, shown in FIG. 3*b* as double-sided tape adhesive 336*b*, is positioned in the opening 348*b*. Various other adhesives, such as glues, curing adhesives, contact adhesives, or the like may be placed or applied to the opening 348*b*. Thus the adhesive may further secure the track 310*b* against a window pane.

Figure 3C:
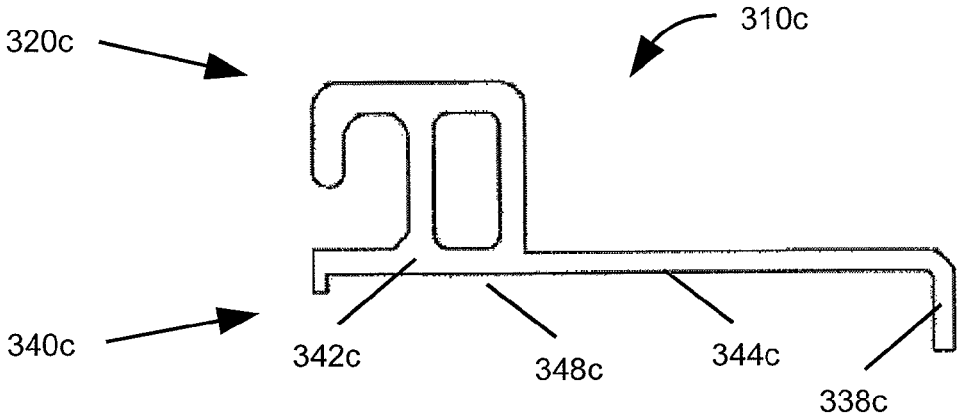
FIG. 3*c* is a side elevational view of a track according to another embodiment of the invention.

FIG. 3*c* is a side elevational view of a track according to another embodiment of the invention. FIG. 3*c* illustrates a track 310*c* comprising a slot 320*c* and a base 340*c*. The base 340*c* comprises a brace portion 342*c* and a flange portion 344*c*. An opening, or slot 348*c* extends from the bottom of the brace portion 342*c* to the bottom of the flange portion 344*c*, thus providing additional area for an adhesive to secure the track 310*c* to a window pane.

The track 310*c* further comprises a window pane lip 338*c*, which may be used to clamp or secure the track 310*c* against the edge of a window pane. For example, the flange portion 344*c* and lip 338*c* may extend inside part of a window frame, and be pushed against the face and side of a window pane to secure the track 310*c* against the pane.

Figure 4:
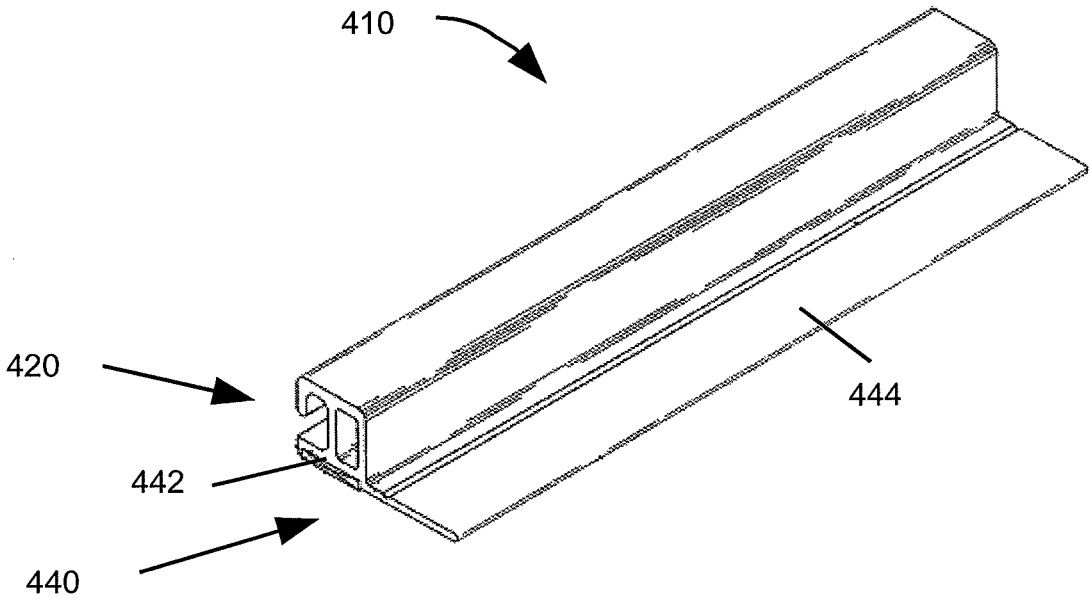
FIG. 4 is a perspective view of a track according to the invention.

FIG. 4 is a fragmented perspective view of a track according to another embodiment of the invention. FIG. 4 comprises a track 410 with a slot 420 and a base 440. The slot 420 extends from the base 440 and comprises a channel that runs the length of the track 410. The base 440 comprises a brace portion 442 and a flange portion 444. As shown in FIG. 4, the flange portion 444 extends along the entire length of the track 410. In other embodiments, the flange portion may only extend across part of the length of the track.

In some embodiments, the track 410 is an integrally formed single-piece construction. The track 400 may typically be formed through an extrusion process, though any suitable process may be used. In one example, track 410 is made of aluminum, which may be extruded, minimizes weight, and permits easy cutting so that an appropriate length may be provided. However, plastics and other suitable materials may be used. In other embodiments, multiple pieces of material may be connected together, for example through bonding, fastening, welding or any other suitable means.

Figure 5:
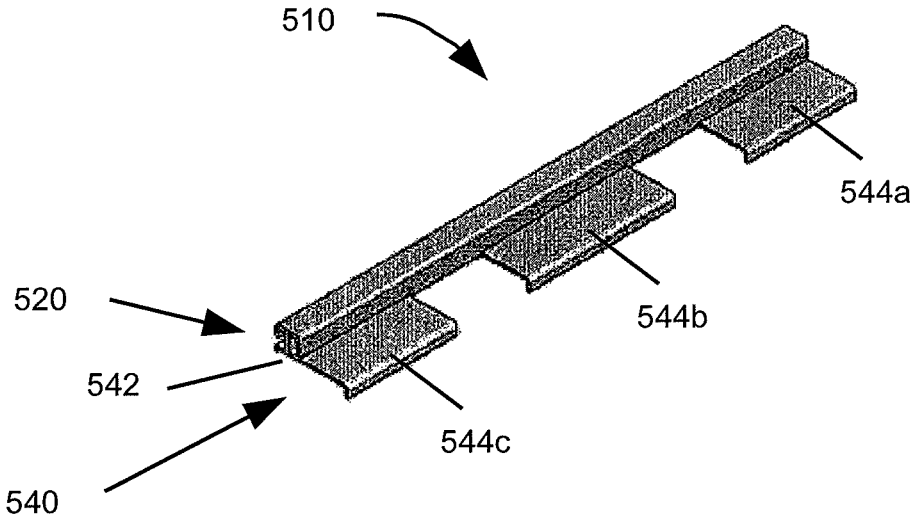
FIG. 5 is a perspective view of a track according to another embodiment of the invention

FIG. 5 is a fragmented perspective view of a track according to another embodiment of the invention. FIG. 5 comprises a track 510 with a slot 520 and a base 540. The base 540 comprises a brace portion 542 and a plurality of discontinuous flange portions 544*a*, 544*b*, and 544*c*. In some embodiments, multiple flange portions may be used to conserve materials or reduce the weight of the track and window.

Figure 6:
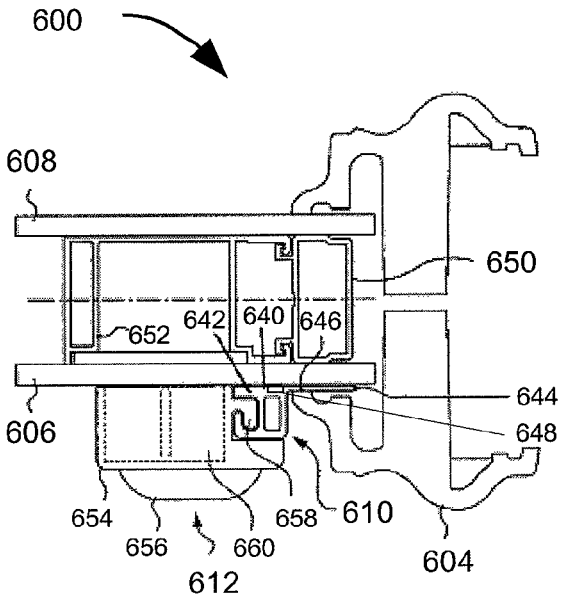
FIG. 6 is a fragmentary cross-sectional view of the track assembly of the invention installed in a window assembly according to the invention.
Figure 7:
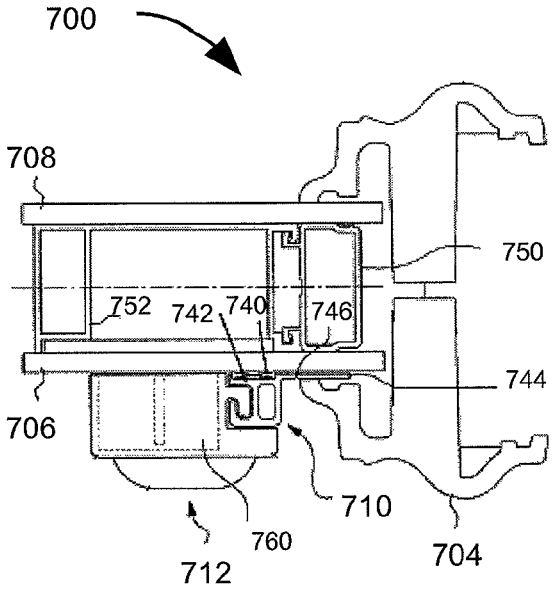
FIG. 7 is a fragmentary cross-sectional view of the track assembly of the invention installed in a window assembly according to the invention.

FIGS. 6 and 7 illustrate the track in various multiple-pane window assemblies. FIG. 6 is a cross-sectional view of the track assembly of the invention installed in a window assembly according to another embodiment of the invention. The window assembly 600 includes a first spaced pane 606 and a second spaced pane 608 held in place by a frame 604.

The window assembly 600 further comprises a track 610 comprising a base 640 with a brace portion 642 and a flange portion 644. The base 640 also comprises a notch 646. A spacer 650 and an operator housing 652 are located between the spaced panes 606, 608. The spacer 650 is located along the outer edge of the spaced panes 606, 608 and may extend all or part of the way around the interior of the frame 604. The operator housing 652 extends vertically along the spaced panes 606, 608. While the operator housing may extend the entire height of the window assembly 600, it may only extend as far as necessary to allow for full movement of the window covering. The operator housing 652 may be located at any point along the edge of the window assembly 600 and be oriented either vertically or horizontally. Operator housing 652 typically holds a mechanism for adjusting the window covering such as an operator and cord system (not shown).

The track 610 is located outside of, and in contact with, the first spaced pane 606. The flange portion 644 of the track 610 extends at least partially into the frame 604. The frame 604 presses against flange portion 644, holding the track 610 in contact with the first pane 606. As discussed above, an adhesive may be provided in a space or opening 648 between the brace portion 642 and the first pane 606 to further secure the track 610 in place. As shown in FIG. 6, the track 610 is positioned so that the back of the slot abuts the frame 604.

An adjuster 612 is attached to the track 610 to allow a user to operate a window covering assembly, such as a blind assembly. The sliding adjuster 612 has an outer cover 654, a handle 656, and a protrusion 658. The protrusion 658 fits in the groove of the slot of the track 610, connecting the sliding adjuster 612 to the track 610. The handle 656 is designed so that a user may easily control the movement of the sliding adjuster 612. While it is contemplated that the sliding adjuster 612 not be in contact with the first pane 606, certain applications may require it. Therefore, the sliding adjuster 612 may be provided with a pad (not shown) attached to its inner surface to reduce contact friction.

In various exemplary embodiments, the sliding adjuster 612 is magnetically connected to an operator (not shown). In these instances, a magnet 660 is disposed inside the outer cover 654 to achieve such a connection. This connection should be of sufficient force to prevent the sliding adjuster 612 from becoming disconnected from the operator during use of the blind assembly.

The track 610 is designed to be used with a variety of different windows, frames, and blind assemblies. As shown in FIGS. 6 and 7, different blind assemblies may have different size spacers 650 and operator housings 652. As the spacer 650 and operator housing 652 are typically not visible through the panes for aesthetic reasons, aligning the sliding adjuster 612 may be difficult. Thus, the base of the track 610 may comprise one or more notches 646, which may be aligned with the frame 604 and/or the spacer 650.

FIG. 7 is a cross-sectional view of the track assembly of the invention installed in a window assembly according to another embodiment of the invention. FIG. 7 comprises a window assembly 700 comprising a window frame 704, a first spaced pane 706 and a second spaced pane 708. A track 710 is positioned on the first spaced pane 706, and comprises a base 740 with a brace portion 742 and a flange portion 744. A sliding adjuster 712 is operably connected to the track 710.

To facilitate alignment of the track 710, the flange portion 744 may have one or more notches 746. The notch 746 allows for proper alignment of the sliding adjuster magnet 760 to the operator magnet (not shown). As best shown in FIGS. 6 and 7, the notch 746 is positioned at a different position with respect to the window frame 704 for the different assemblies. The difference in position of the notch 746 corresponds to the dimensions of the spacer 750 and the operator housing 752. The notch 746 is placed so that the sliding adjuster 712 connected to the track 710 will be aligned with the operator housing 752. As the size of the spacer 750 and the operator housing 752 differ, so will the position of the notch 746.

In FIG. 6, the track 610 is positioned so that the back of the slot abuts the frame 604. In FIG. 7, the notch 746 is aligned with the edge of the frame 704. Accordingly, a company using the track 710 for multiple types of windows will know the dimensions of their assemblies and how to properly align the notch 746. The track 710 may be formed so that the notch 746 is placed to correspond to different window assemblies. In some embodiments, the track 710 may have more than one notch 746.

The exemplary embodiments of the invention described above overcome the disadvantages of the prior art. By slidably connecting the sliding adjuster 712 to the track 710 via the channel in the track 710, the sliding adjuster 712 will neither scratch the glass, separate from the window assembly 700, nor separate from the operator. In addition, the track 710 may be used with a variety of window frames, operator housings, and spacer combinations unlike prior-art tracks integrally molded into a frame. Finally, the track 710 extends at least partially into the frame, maintaining a secure connection that prevents the track 710 from separating from the window assembly.

Although exemplary embodiments such as window 700 are shown with two spaced panes, other embodiments may comprise three or more window panes, with at least two spaced panes.

The foregoing description of preferred embodiments of the present invention has been presented for the purpose of illustration. It is not intended to be exhaustive or to limit the invention to the precise forms disclosed. Obvious modifications or variations are possible in light of the above teachings. The embodiments disclose hereinabove were chosen in order to best illustrate the principles of the present invention and its practical application to thereby enable those of ordinary skill in the art to best utilize the invention in various embodiments and with various modification as are suited to the particular use contemplated, as long as the principles described herein are followed. Thus, changes can be made in the above-described invention without departing from the intent and scope thereof. Moreover, features or components of one embodiment may be provided in another embodiment. Thus, the present invention is intended to cover all such modification and variations.

What is claimed is:

1. A track for an adjustable blind assembly comprising:

a base comprising a flange portion and a brace portion, the flange portion comprising a plurality of discontinuous flange portions extending in a first direction from the brace portion and securable to a spaced window pane by a window frame; and a slot extending from said brace portion and providing a channel for a sliding adjuster;

the slot comprising a side wall and a back wall extending from said brace portion, a top wall connected to the side wall and the back wall, and a protrusion extending from the top wall;

the side wall, the back wall and at least a portion of the top wall collectively defining a hollow tubular cavity;

said protrusion, said side wall and a portion of said base define said channel, said channel being open in a second direction opposite to said first direction.

2. The track according to claim 1, wherein each of the discontinuous flange portions comprises a lip.

3. The track according to claim 1, wherein the discontinuous flange portions being formed as spaced rectangular members extending in the first direction from the brace portion.

4. The track according to claim 1, wherein the track is made of an extruded material.

5. The track according to claim 1, wherein each of the discontinuous flange portions has a first surface and an oppositely disposed second surface, the first surface being securable to the spaced window panel by insertion of the discontinuous flange portion into the window frame, the second surface comprising a notch.

6. The track according to claim 5, wherein the notch extends along the length of the discontinuous flange portion.

7. The track according to claim 6, wherein said notch is disposed parallel to said back wall to align said track with respect to said window pane.

8. The track according to claim 5, wherein said brace portion of the base has a first surface and an oppositely disposed second surface, the first surface of said brace portion being securable to said spaced window pane; wherein said brace portion comprises an opening recessed into said first surface thereof, said opening having a length that is smaller than a length of said top wall, wherein an adhesive is disposed within said opening, and wherein said first surface of said brace portion is flush with an exposed surface of said adhesive to secure said track to the spaced window pane.

9. The track according to claim 8, wherein the adhesive is a double-sided tape, a glue, a curing adhesive, or a contact adhesive.

10. A window assembly comprising:

a window comprising a frame, first and second spaced panes and a window covering assembly located between the panes;

a track comprising:

a base comprising a flange portion and a brace portion, the flange portion comprising a plurality of discontinuous flange portions extending in a first direction from the brace portion and securable to a spaced window pane by a window frame; and a slot extending from said brace portion and providing a channel;

the slot comprising a side wall and a back wall extending from said brace portion, a top wall connected to the side wall and the back wall, and a protrusion extending from the top wall;

the side wall, the back wall and at least a portion of the top wall collectively defining a hollow tubular cavity;

said protrusion, said side wall and a portion of said base define said channel, said channel being open in a second direction opposite to said first direction; and a sliding adjuster received by the channel in said slot and operably associated with the window covering assembly.

11. The window assembly according to claim 10, wherein the window covering assembly is a window blind assembly, a window curtain assembly, or a window shutter assembly.

12. The window assembly according to claim 10, wherein the sliding adjuster comprises a magnet.

13. The window assembly according to claim 10, wherein each of the discontinuous flange portions comprises a lip.

14. The window assembly according to claim 10, wherein the discontinuous flange portions being formed as spaced rectangular members extending in the first direction from the brace portion.

15. The window assembly according to claim 10, wherein each of the discontinuous flange portions has a first surface and an oppositely disposed second surface, the first surface being securable to the spaced window panel by insertion of the discontinuous flange portion into the window frame, the second surface comprising a notch.

16. A door assembly comprising:

a door;

a window received in an opening of the door, the window comprising a frame, first and second spaced panes and a window covering assembly located between the panes;

a track comprising:

a base comprising a flange portion and a brace portion, the flange portion comprising a plurality of discontinuous flange portions extending in a first direction from the brace portion and securable to a spaced window pane by a window frame; and a slot extending from said brace portion and providing a channel;

the slot comprising a side wall and a back wall extending from said brace portion, a top wall connected to the side wall and the back wall, and a protrusion extending from the top wall;

the side wall, the back wall and at least a portion of the top wall collectively defining a hollow tubular cavity;

said protrusion, said side wall and a portion of said base define said channel, said channel being open in a second direction opposite to said first direction; and a sliding adjuster received by the channel in said slot and operably associated with the window covering assembly.

17. The door assembly according to claim 16, wherein the sliding adjuster comprises a magnet.

18. The door assembly according to claim 16, wherein each of the discontinuous flange portions comprises a lip.

19. The door assembly according to claim 16, wherein the discontinuous flange portions being formed as spaced rectangular members extending in the first direction from the brace portion.

20. The door assembly according to claim 16, wherein each of the discontinuous flange portions has a first surface and an oppositely disposed second surface, the first surface being securable to the spaced window panel by insertion of the discontinuous flange portion into the window frame, the second surface comprising a notch.

* * * * *